US005460026A

United States Patent [19]

Schäfer

[11] Patent Number: 5,460,026

[45] Date of Patent: Oct. 24, 1995

[54] METHOD OF AND APPARATUS FOR THE CUTTING OF AN OPENING IN A HOLLOW BODY

[75] Inventor: August W. Schäfer, Drolshagen, Germany

[73] Assignee: Wilhelm Schafer Maschinenbau GmbH & Co., Winsdorf, Germany

[21] Appl. No.: 270,236

[22] Filed: Jul. 1, 1994

[30] Foreign Application Priority Data

Jul. 2, 1993 [DE] Germany ..... 43 22 063.0

[51] Int. Cl.[6] ..... B21D 26/02; B21D 28/18

[52] U.S. Cl. ..... 72/55; 83/54

[58] Field of Search ..... 72/58, 61, 55; 83/53, 54

[56] References Cited

U.S. PATENT DOCUMENTS 3,487,668 1/1970 Fuchs, Jr. ..... 72/55
3,495,486 2/1970 Fuchs, Jr. ..... 83/53
4,989,482 2/1991 Mason ..... 83/54

FOREIGN PATENT DOCUMENTS 1552122 3/1971 Germany .
4035625 5/1992 Germany .

*Primary Examiner*—David Jones
*Attorney, Agent, or Firm*—Herbert Dubno

[57] ABSTRACT

In the internal pressure shaping of a tubular workpiece into a hollow body in a surrounding die, an opening can be formed in a wall of the workpiece by advancing a plunger while the maximum internal pressure is maintained to partially cutout a piece of the wall corresponding in shape to the plunger. That piece remains attached by a portion of the thickness of the wall. Their upon the internal pressure is reduced and the plunger is retracted until the cutout portion is pressed fully from the workpiece.

4 Claims, 2 Drawing Sheets

METHOD OF AND APPARATUS FOR THE CUTTING OF AN OPENING IN A HOLLOW BODY

FIELD OF THE INVENTION

The present invention relates to a method of and an apparatus for the cutting of an opening in a hollow body and, more particularly, the cutting of such an opening in a hollow body in conjunction with a pressure forming processes in which the hollow body is formed by the generation of an internal pressure within a workpiece sufficient to expand that workpiece into and against a die surrounding same.

BACKGROUND OF THE INVENTION

In the high pressure forming of tubular workpieces by expanding same against a surrounding die or tool, it is common practice to close the ends of the tubular workpiece with plugs, plungers or rams and to introduce a hydraulic medium or some other fluid under elevated pressure into the workpiece to expand the latter outwardly against the surrounding die or tool.

In this high pressure forming method, a mandrel or inner die member is avoided.

If it is desired to provide an opening or cut out in such a hollow body, i.e. in the wall thereof, this has been done hitherto in a separate process outside the internal high pressure shaping apparatus, for example, by plasma or laser cutting or sawing. For this additional step, the shaped workpiece must be removed from the die, transported to another apparatus and clamped or positioned therein to allow cut out of the opening. A simple and rapid stamping with a punch or the like is not possible because of the danger that this will bend the wall at least in a region adjacent the cut out.

In DE 40 35 625, however, a process has been described for producing an opening in a wall expanded against a tool or die in the manner described above. In this case, a recess is provided in the die, the edge of which represents a cutting edge and a plunger supports the portion of the wall disposed within the recess.

In this process, the pressure causes the wall to bulge into the recess. While the wall is supported around the cutting edge of the recess, the deformation of the wall portion inwardly of the cutting edge cannot be fully controlled and some deformation of the wall may occur. A similar process is described in DE-AS 1 552 122 wherein the plunger in the recess recedes at a controlled rate as the workpiece portion is cut out. Here to a fully reliable severing of the cut out piece in a uniform manner cannot be insured.

OBJECTS OF THE INVENTION

It is therefore, the principal object of the present invention to provide an improved method of cutting out an opening in the wall of a pressure-formed workpiece in a simple, rapid and high-quality manner so that the process is highly reproducible.

Another object of the invention is to provide a process for the purposes described which will avoid the drawbacks of earlier methods.

It is also an object of the invention to provide an apparatus for carrying out the improved process.

SUMMARY OF THE INVENTION

These objects are attained, in accordance with the invention in a method in which the cutting use of the portion of the wall to form the opening is effected directly following the internal pressure forming the workpiece into the hollow body. The cut out is initially precut while the maximum internal pressure developed during the shaping step is maintained until it is attached to the remainder of the wall by only a residual wall thickness which is a fraction of the original wall thickness. Subsequently, this cut out is completely cut out from the wall at a reduced above-ambient pressure. In a preferred embodiment, the final cutting is effected with a reduced above-ambient pressure with which the precut wall region is pressed outwardly upon retraction of the plunger. This final cutting can be effected in the course of reducing the internal pressure to ambient. More particularly, the method of the invention can comprise the steps of:

(a) juxtaposing a wall of a hollow workpiece with a shaping die surrounding the workpiece;

(b) internally pressurizing the hollow workpiece with a workpiece-deforming medium at a pressure sufficient to plastically deform the wall against the die, thereby shaping the workpiece to conform to the die, the pressure having a maximum value in deforming the workpiece against the die;

(c) maintaining the maximum value of the pressure and advancing a hole-forming plunger inwardly from the die to initiate cutting of a piece of the wall therefrom in a shape corresponding to a shape of the plunger and the opening, the maintained pressure preventing unacceptable deformation of the wall around the piece;

(d) after initiation of cutting of the piece from the wall and while the piece remains attached to the wall by a residual wall thickness, reducing the pressure of the medium within the workpiece and withdrawing the plunger through the thickness of the wall and wholly out of the wall, thereby fully separating the piece from the wall by pressing the piece therefrom with residual over-ambient pressure of the medium; and (e) only upon full separation of the piece from the wall, bringing pressure of the medium in the workpiece to ambient pressure.

The invention also comprises an apparatus for carrying out the method and which comprises a common control unit for controlling both the internal pressure within the workpiece and the pressure with which the plunger is supported against the wall of the workpiece. The apparatus can comprise in particular:

a shaping die surrounding the workpiece;

two rams engaged in opposite ends of the workpiece, at least one of the rams being provided with an inlet for introducing a pressurizing medium into the workpiece;

means connected with the inlet for internally pressurizing the hollow workpiece with a workpiece-deforming medium at a pressure sufficient to plastically deform the wall against the die, thereby shaping the workpiece to conform to the die, the pressure having a maximum value in deforming the workpiece against the die;

a hole-forming plunger displaceable inwardly and outwardly on the die and having a shape corresponding to that of the opening;

means for maintaining the maximum value of the pressure and advancing the hole-forming plunger inwardly from the die to initiate cutting of a piece of the wall therefrom in a shape corresponding to a shape of the plunger and the opening, the maintained pressure preventing unacceptable deformation of the wall around the piece;

means effective after initiation of cutting of the piece from the wall and while the piece remains attached to the wall by a residual wall thickness, for reducing the pressure of the medium within the workpiece and withdrawing the plunger through the thickness of the wall and wholly out of the wall, thereby fully separating the piece from the wall by pressing the piece therefrom with residual over-ambient pressure of the medium; and means effective only upon full separation of the piece from the wall, bringing pressure of the medium in the workpiece to ambient pressure.

The die, therefore, can be a combined forming die and stamping tool and the forming and stamping in one unit in practically a single process step can avoid hitherto unavoidable detrimental peaks in the die or machine resulting from the sudden expansion of the medium upon complete separation of the cut out portion or the like. This is in short by having a single control for both the pressure within the workpiece and the pressure supporting the plunger. The detrimental effect of heat upon zones of the workpiece which are adjacent the cut out and corresponding thermal cut out methods are also avoided.

BRIEF DESCRIPTION OF THE DRAWING

The above and other objects, features, and advantages will become more readily apparent from the following description, reference being made to the accompanying drawing in which.

SPECIFIC DESCRIPTION

Figure 7:
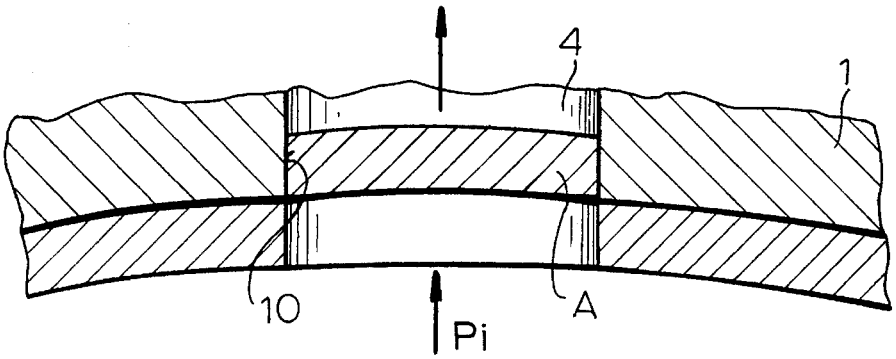
FIG. 7 is a view similar to FIGS. 5 and 6 but illustrating the position when the plunger has been fully retracted and the cutting operation is complete.

The apparatus shown in the drawing serves to cut out from a hollow body H a portion A of the wall thereof to form an opening 10 (FIG. 7) in that wall, in conjunction with a shaping of the body in a die or tool 1.

Figure 3:
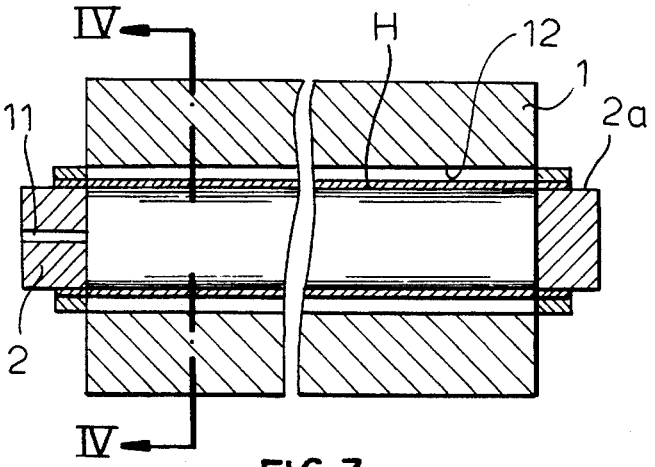
FIG. 3 is a longitudinal section through the apparatus, also in highly diagrammatic form.
Figure 4:
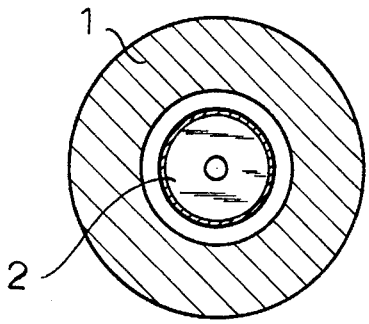
FIG. 4 is a cross sectional view taken along the line IV—IV of FIG. 3.

As can be seen from FIGS. 3 and 4, the die or shaping tool comprises the die member 1 surrounding the hollow body or workpiece H, here shown as a tube, and a pair of end-closing plungers 2 and 2*a*, the former having a passage 11 through which the high pressure medium can be delivered to the interior of the hollow workpiece H. The inner contour 12 of the die 1 will correspond to the outer contour of the workpiece H when forming is complete. The die 1 is equipped with a hole-stamping plunger 4 which can have a hydraulic drive 5 which has a common controller 6 with the internal pressure delivered to the workpiece and supplied by a high pressure source 3.

With this apparatus, after any preforming of the hollow body H by a pressure medium, the internal pressure is brought to its maximum $Pi_{max}$ which can be a calibration pressure or the like imparting the final plastic deformation to the workpiece and setting the latter to the interior of the die 1.

Figure 1:
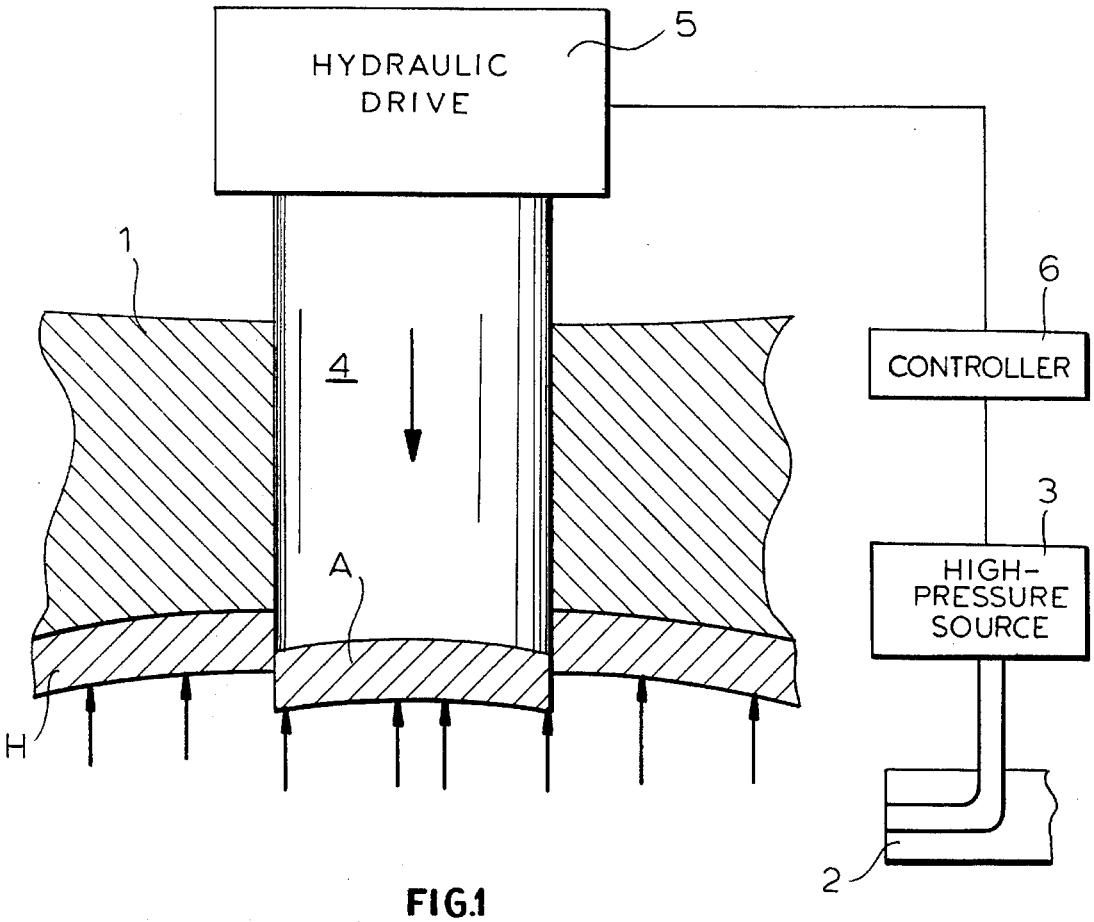
FIG. 1 is a schematic section through an apparatus for carrying out the method of the invention.
Figure 5:
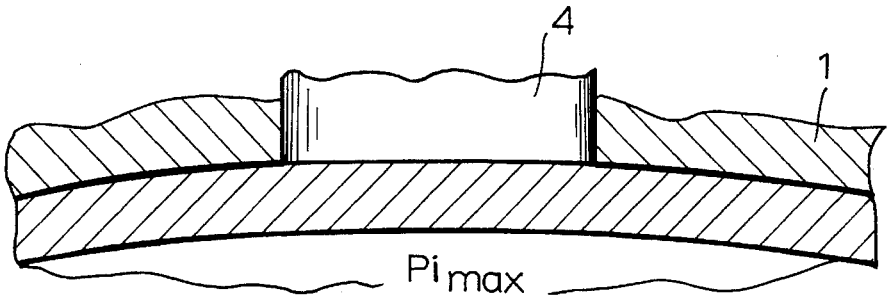
FIG. 5 is a view similar to FIG. 1 showing the stage by advance of the plunger to commence the cutting operation.
Figure 6:
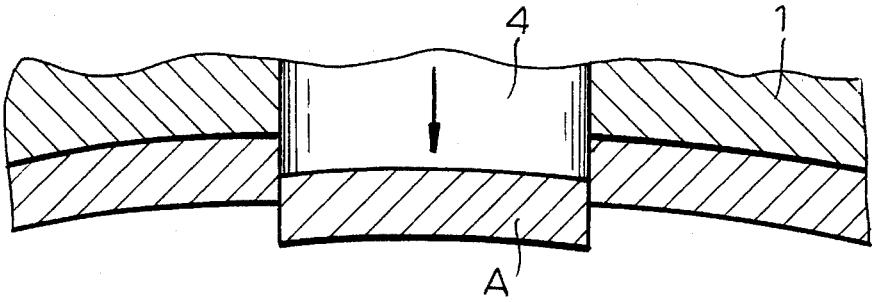
FIG. 6 illustrates the stage at the beginning of lowering of the internal pressure and retraction of the plunger.

The horizontal plungers 2, 2*a* remaining in their last positions and with the internal pressure at its maximum (FIG. 5), the plunger 4 is advanced inwardly in the direction of the arrows in FIGS. 1 and 6 but only so far that the cut out portion A remains attached to the wall by a residual thickness of several tenths of a mm.

The internal pressure is then significantly reduced but not to zero. The plunger 4 is then retracted (FIG. 7) until the piece A is fully cut loose and displaced out of the wall, i.e. no longer is disposed in the hollow body H. Then the pressure can be reduced to ambient. With this mode of operation, sudden pressure drops and corresponding impact like loads on the machine elements are avoided.

Figure 2:
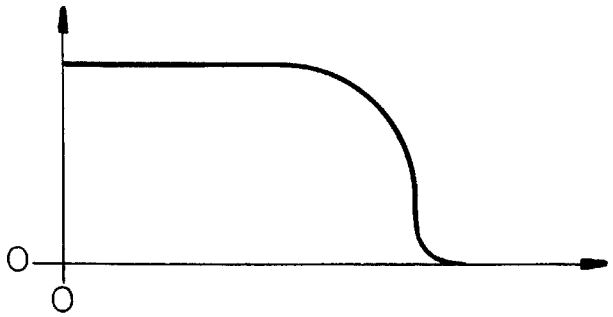
FIG. 2 is a graph serving to facilitate description of the operation of the apparatus of FIG. 1.

FIG. 2 plots the internal pressure in the workpiece as a function of the displacement of the plunger or the wall thickness.

I claim:

1. A method of cutting an opening in a wall of a workpiece, comprising the steps of:

(a) juxtaposing a wall of a hollow workpiece with a shaping die surrounding said workpiece;

(b) internally pressurizing said hollow workpiece with a workpiece-deforming medium at a pressure sufficient to plastically deform said wall against said die, thereby shaping said workpiece to conform to said die, said pressure having a maximum value in deforming said workpiece against said die;

(c) maintaining said maximum value of said pressure and advancing a hole-forming plunger inwardly from said die to initiate cutting of a piece of said wall therefrom in a shape corresponding to a shape of said plunger and said opening, the maintained pressure preventing unacceptable deformation of said wall around said piece;

(d) after initiation of cutting of said piece from said wall and while said piece remains attached to said wall by a residual wall thickness, reducing the pressure of the medium within said workpiece and withdrawing said plunger through the thickness of said wall and wholly out of said wall, thereby fully separating said piece from said wall by pressing said piece therefrom with residual over-ambient pressure of said medium; and (e) only upon full separation of said piece from said wall, bringing pressure of said medium in said workpiece to ambient pressure.

2. The method defined in claim 1 wherein withdrawal of said plunger is effected in step with reduction of pressure of said medium in said workpiece in step (d).

3. A method of cutting an opening in wall of a workpiece, comprising the steps of:

(a) juxtaposing a wall of a hollow workpiece with a shaping die surrounding said workpiece;

(b) internally pressurizing said hollow workpiece with a workpiece-deforming medium at a pressure sufficient to plastically deform said wall against said die, thereby shaping said workpiece to conform to said die, said pressure having a maximum value in deforming said workpiece against said die;

(c) maintaining said maximum value of said pressure and advancing a hole-forming plunger inwardly from said die to initiate cutting of a piece of said wall therefrom in a shape corresponding to a shape of said plunger and said opening, the maintained pressure preventing unacceptable deformation of said wall around said piece;

(d) after initiation of cutting of said piece from said wall and while said piece remains attached to said wall by a residual wall thickness, reducing the pressure of the medium within said workpiece and fully separating said piece from said wall; and (e) only upon full separation of said piece from said wall, bringing pressure of said medium in said workpiece to ambient pressure.

4. An apparatus for cutting an opening in a wall of a tubular workpiece, comprising:

a shaping die surrounding said workpiece;

two rams engaged in opposite ends of said workpiece, at least one of said rams being provided with an inlet for introducing a pressurizing medium into said workpiece;

means connected with said inlet for internally pressurizing said hollow workpiece with a workpiece-deforming medium at a pressure sufficient to plastically deform said wall against an internal surface of said die, thereby shaping said workpiece to conform to said die, said pressure having a maximum value in deforming said workpiece against said die;

a hole-forming plunger displaceable inwardly and outwardly on said die and having a shape corresponding to that of said opening;

means for maintaining said maximum value of said pressure and advancing said hole-forming plunger inwardly from said surface die to initiate cutting of a piece of said wall therefrom in a shape corresponding to a shape of said plunger and said opening, the maintained pressure preventing unacceptable deformation of said wall around said piece;

means effective after initiation of cutting of said piece from said wall and while said piece remains attached to said wall by a residual wall thickness, for reducing the pressure of the medium within said workpiece and withdrawing said plunger through the thickness of said wall and wholly out of said wall and outwardly beyond said surface, thereby fully separating said piece from said wall by pressing said piece therefrom with residual over-ambient pressure of said medium; and means effective only upon full separation of said piece from said wall, bringing pressure of said medium in said workpiece to ambient pressure.

* * * * *